US005811749A

United States Patent [19]

Bausch et al.

[11] Patent Number: 5,811,749

[45] Date of Patent: Sep. 22, 1998

[54] ELECTRICAL SWITCHING DEVICE WITH BLOW-OUT CHANNELS FOR ARC GASES

[75] Inventors: Christoph Bausch, Bornheim; Franz Böder, Ahrbrück; Bernd Howald, Bonn, all of Germany

[73] Assignee: Klöckner-Moeller GmbH, Bonn, Germany

[21] Appl. No.: 734,628

[22] Filed: Oct. 18, 1996

Related U.S. Application Data

[63] Continuation-in-part of PCT/DE95/00520 Apr. 20, 1994 published as WO95/29497 Nov. 2, 1995.

[30] Foreign Application Priority Data

Apr. 20, 1994 [DE] Germany ..... 94 06 404 U

[51] Int. Cl.[6] ..... H01H 9/02; H01H 9/34

[52] U.S. Cl. ..... 218/157; 200/306

[58] Field of Search ..... 200/304–306; 337/203, 250, 272, 328; 218/22–40, 154–158; 335/201, 202

[56] References Cited

U.S. PATENT DOCUMENTS

| | | | |
|---|---|---|---|
| 2,839,641 | 6/1958 | Edmunds | 218/149 |
| 3,025,376 | 3/1962 | Yarrick | 218/149 |
| 3,780,249 | 12/1973 | Harper | 218/157 X |
| 4,620,076 | 10/1986 | Mrenna et al. | 200/306 X |
| 4,631,376 | 12/1986 | Leone | 218/157 X |
| 4,639,564 | 1/1987 | Grunert et al. | 218/156 |
| 4,650,940 | 3/1987 | Grunert et al. | 218/155 |
| 4,790,778 | 12/1988 | Seidenbusch | 439/811 |
| 4,928,080 | 5/1990 | Jacobs et al. | 335/202 |
| 4,945,327 | 7/1990 | Doughty et al. | 335/202 X |
| 5,166,651 | 11/1992 | Jacobs et al. | 335/202 |
| 5,241,289 | 8/1993 | Markowski et al. | 335/201 |
| 5,258,733 | 11/1993 | Link et al. | 335/172 |
| 5,304,761 | 4/1994 | Rosen et al. | 218/157 |
| 5,569,894 | 10/1996 | Uchida et al. | 218/157 X |
| 5,589,672 | 12/1996 | Uchida et al. | 439/157 X |

FOREIGN PATENT DOCUMENTS

| | | | |
|---|---|---|---|
| 0201731 | 11/1986 | European Pat. Off. . | |
| 4303550 | 8/1993 | Germany . | |
| WO95/29497 | 11/1995 | WIPO | H01H 9/34 |

*Primary Examiner*—J. R. Scott
*Attorney, Agent, or Firm*—Nils H. Ljungman and Associates

[57] ABSTRACT

An electrical switch is intended to prevent hot arc gases from contacting the terminal screw units. The arc gases are to flow off in an already deionized manner so that no damage is caused even when they flow out towards the electric cable terminals without the need for additional shielding for the terminals. A terminal cover section is designed with blow-out channels which are fully encapsulated with respect to the terminal screws and to the terminal chambers and have an outlet aperture each. To fully encapsulate and provide access to each of the terminal screws, a location dome passes through each blow-out channel. At the points where the through apertures join the quench chambers, the inserted terminal cover section is sealed against the separating wall of the housing in the region of the blow-out channel inlet apertures. The arc gases flow from arc quenching chambers through a partition by way of passage openings. The passage openings open into the blow-out channels, which blow-out channels are wider than the passage openings. Then the arc gases flow through a portion of the blow-out channels narrowed by the presence of the location domes passing through the blow-out channels. As the arc gases pass beyond the location domes, the blow-out channels widen as a result of the absence of the location domes.

20 Claims, 6 Drawing Sheets

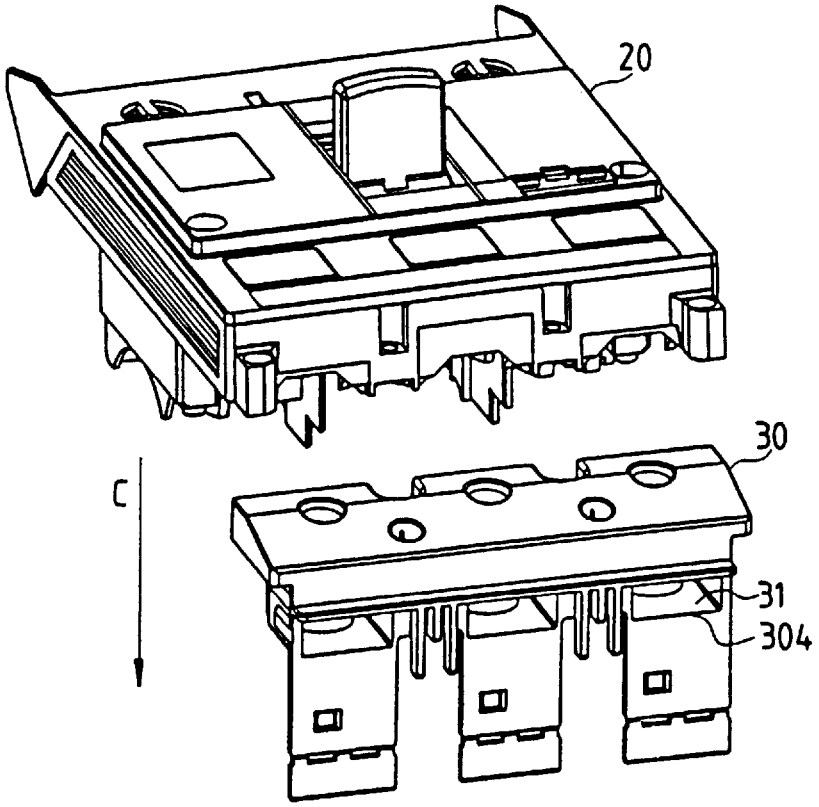
*Fig.1*
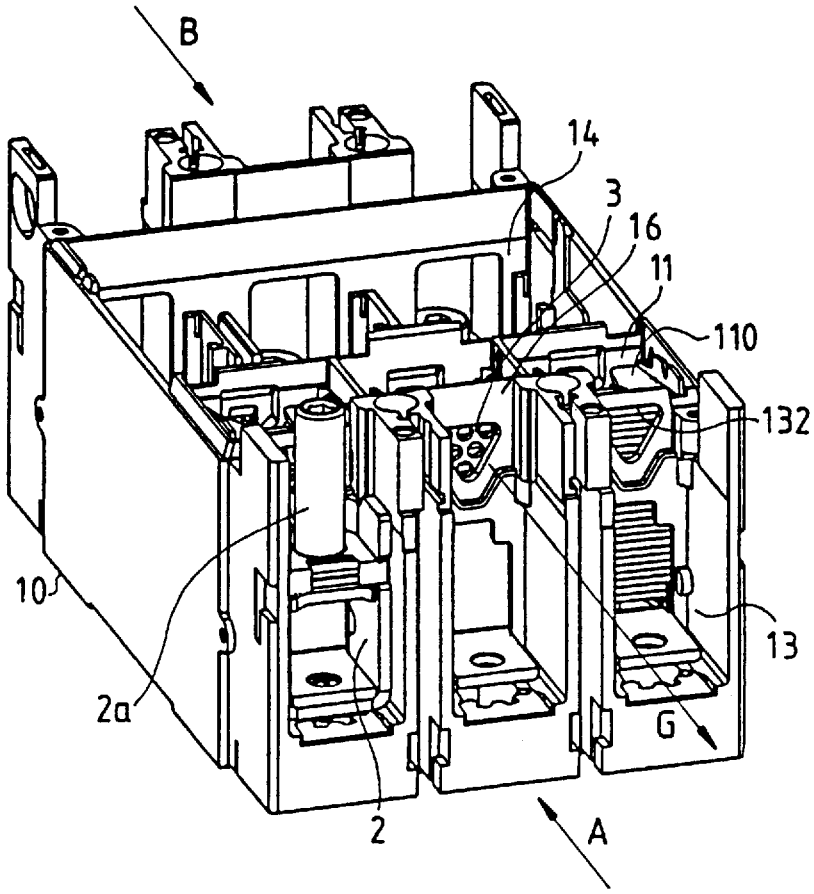

*Fig. 6*
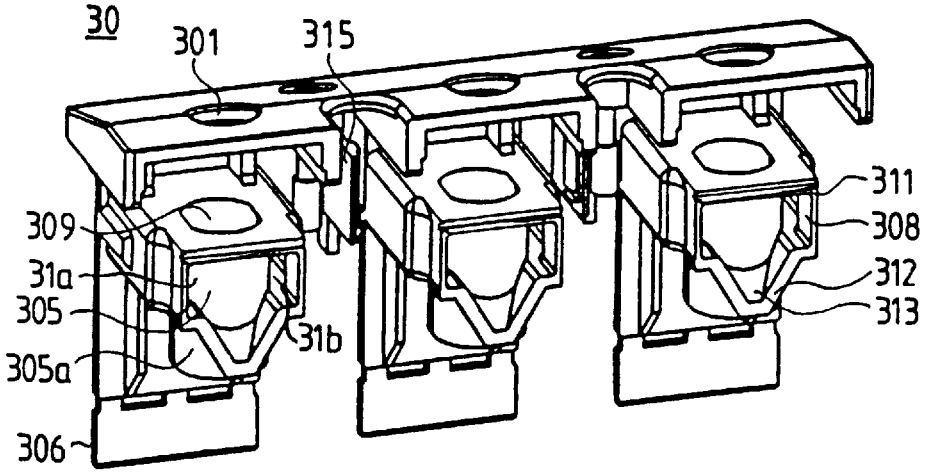
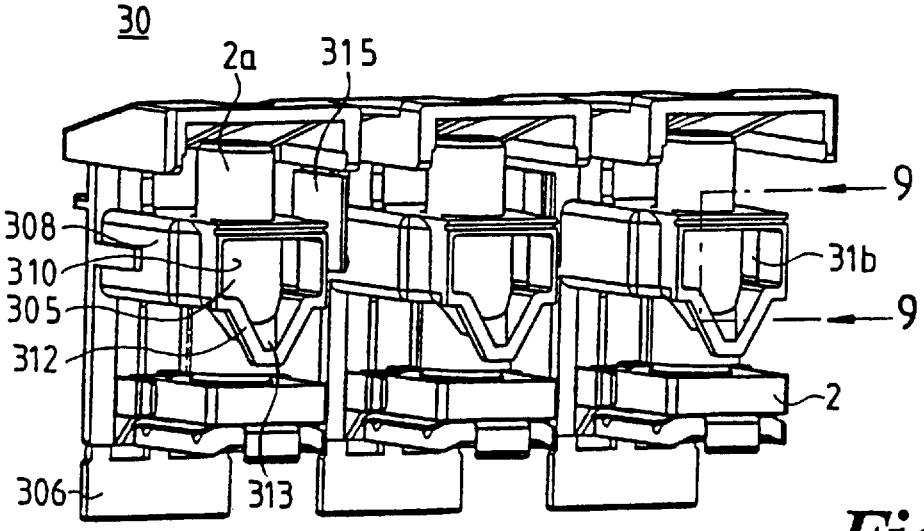
*Fig. 7*

ELECTRICAL SWITCHING DEVICE WITH BLOW-OUT CHANNELS FOR ARC GASES

This application is a continuation-in-part of PCT/DE95/00520 Apr. 20, 1994 published as WO95/29497 Nov. 2, 1995.

BACKGROUND OF THE INVENTION

1. Field of the Invention

This invention relates to an electrical switching device with a housing containing the actuation components of the switching device, including arc quenching chambers, with a terminal side which is separated from the quenching chambers by a partition of the housing, with open terminal chambers for the insertion of terminal screw units with a terminal screw, with an opposite terminal side and with a terminal cover part for the terminal screw units on the quenching-chamber-side terminal side with a through hole which is coaxial to each terminal screw for the screw attachment, whereby corresponding to each quenching chamber there are both passage openings to the quenching chambers in the partition and outlet openings in the terminal cover part on the terminal side for the discharge of arc gases from the quenching chambers.

2. Background Information

Prior art document European Patent No. 0201731 B1 describes a switch which has a blow-out system for the arc gases of the type described above, but in which the discharge path for the arc gases is only partly encapsulated by the terminal chambers on the quenching-chamber-side terminal side, so that arc gases also flow over the terminal screw unit for the terminals as they are expelled. The prior art document claims that the disadvantages of this arrangement are offset by the simultaneous advantage of a chimney effect for the feed of fresh air through the screw passage for the terminal screw of the terminal screw unit. On this switch, however, it cannot be assumed that there is sufficient protection of the switch in the vicinity of the terminal side against the hot arc gases. Prior art document German Patent No. 4303550 A1 describes a switch which is protected against the effects of arcing, on which, in the vicinity of the power supply terminal side, there is also an exhaust gas partition in the terminal chambers, whereby the discharge of the hot arc gases on the terminal side is prevented and the hot arc gases are deflected by 90 degrees and exit on the top of the housing. In this version, too, there is still a connection between the terminal chambers and the blow-out channels for the hot gases in the vicinity of the access to the terminal screws.

OBJECT OF THE INVENTION

The object of the invention is to configure the blow-out system for the hot arc gases of an electrical switching device with a quenching chamber in which the hot arc gases are blown out in the vicinity of the quenching-chamber-side terminal side, to create a switching device which is protected against the effects of arcing. In particular, the hot gases must be prevented from coming into contact with the terminal screw units, and the hot arc gases must also be discharged so that no problems will occur even when they exit toward the electrical conductor connections on the quenching-chamber-side terminal side. In particular, no additional shielding of the conductor connections on the quenching-chamber-side terminal side is necessary.

SUMMARY OF THE INVENTION

The invention teaches that the object stated above is accomplished by means of an electrical switching device of the type described above in which the terminal cover part is realized with extinguishing channels which are completely encapsulated with respect to the terminal screw units and the terminal chambers, with an inlet opening and an outlet opening for the flow of the arc gases, and in which the terminal cover part, when it is installed on the housing in the vicinity of the inlet openings of the blow-out channels, is in tight contact against the partition which adjoins the passage openings.

The invention teaches that there is a closed blow-out channel which is encapsulated with respect to the quenching-chamber-side terminal side of the housing, which blow-out channel is connected with the terminal cover part and can be connected tight to the passage opening for the arc gases to flow out of the quenching chamber. The outlet opening of this blow-out channel, which is thus encapsulated on all sides, is located on the quenching-chamber-side terminal side so that contact with the conductors connected to the terminals is prevented. The invention teaches that a short flow path in a plane is provided, whereby the invention eliminates the possibility that the arc gases on this path can penetrate into the terminal chambers with the terminal screw units on the quenching-chamber-side terminal side of the switch.

Advantageous embodiments of the invention are described in the characterizing portions of the subclaims.

In one preferred embodiment of the invention, the blow-out channels are formed on the terminal cover part in the form of molded channel ducts, each of which is completely penetrated by a location dome which runs perpendicular to the direction of flow of the arc gases and coaxial to the terminal screw which is inserted perpendicularly into the respective terminal chamber, which location dome has a through hole for the terminal screw, and the blow-out channel is divided over portions of its length into two partial sub-channels which have a total flow cross section which is less than that of the remaining segments of the blow-out channel. Consequently, the access path for the actuation of the terminal screws of the terminal screw units which sit in the terminal chambers and the flow path, i.e. the blow-out channel for the hot arc gases, are completely isolated from one another by means of two hollow bodies which run through one another. In this case, the flow path for the hot arc gases with the blow-out channel runs perpendicular to the direction of actuation, i.e. the direction in which the terminal screws are screwed in.

The housing which surrounds the blow-out channel, in the form of the channel ducts, preferably has a length which equals the depth of the terminal chamber, so that the housing divides the terminal chamber.

For protection against contact with live, bare metal parts, it is appropriate if the terminal cover part has an angled shape which has a roof side which covers the terminal chambers on the upper side of the housing, and cover webs which are connected to the roof side at an angle and which cover webs partly cover the open front sides of the terminal chambers of the housing, whereby the channel ducts of the blow-out channels are molded onto the cover webs.

An additional important feature of the invention is the tight connection of the blow-out channels of the terminal cover part with the housing, i.e. to the passage openings of the housing to the arc quenching chamber, because a sealing collar which projects into the terminal chamber is molded at the connection points between the blow-out channels and the passage openings on the partition, underneath the passage openings, and the input opening of the blow-out channels on the terminal cover part can be attached to this sealing collar, because the inlet opening is shaped with a corresponding, downward-pointing overhang.

In an additional advantageous embodiment of the invention, at the connection point between the blow-out channels and the passage openings of the partition, on the contact surfaces, at least in certain areas, grooves on the channel ducts and/or sealing collars form a labyrinth seal. In this manner, the hot arc gases, as a result of the tight contact between the blow-out channel and the partition, cannot get into the terminal chambers of the quenching-chamber-side terminal side.

In an additional embodiment of the invention, the flow path of the hot arc gases, on the way from the quenching chamber to the outside, has a cross section which becomes narrower in at least two points and then expands again, thereby guaranteeing a good mixing and cooling of the gases, as well as their deionization. This mixing and deionization occur because the flow path of the arc gases, as the flow path exits the quenching chambers in the vicinity of the passage openings, is realized with a blow-out damper which is provided with outlet openings and which blow-out damper partly covers the passage openings, with a first narrower portion which is followed by an expansion of the flow path at the entrance to the blow-out channel, and then with a second narrow portion at the point where the gases flow around the location dome which penetrates the blow-out channel and reduces its flow cross section.

In an additional advantageous embodiment, the terminal cover part which can be fastened to the housing by means of screws can be pressed by an application web molded into the screw holes of the terminal cover part with the ends of the channel ducts comprising the inlet openings of the blow-out channels against the partition of the housing. That creates a seal, whereby the terminal cover part inserted into the housing is fastened to the housing, and simultaneously, by means of the application webs, a force component is also created which presses the terminal cover part on the terminal side, i.e. the partition, toward the quenching chambers.

An additional embodiment makes it possible to retain, i.e. to hold the terminal screw unit in the terminal cover part so that the terminal screw unit does not fall out during the assembly process. This is accomplished because the location dome has a projection which extends into the through hole and holds the terminal screw by engagement with its thread when the terminal cover part is inserted into the housing. A rapid assembly and disassembly are thereby possible. The terminal cover part can be completely assembled and disassembled with the terminal screw units. But it is also possible to remove the terminal screw units from the terminal cover part individually and re-insert them.

The invention also teaches that it is advantageous if the outlet openings of the blow-out channels are located on the terminal side which is open toward the front of the terminal chambers of the housing.

The invention teaches that the terminal cover part with the integrated blow-out channel, which terminal cover part can be removed from the housing of the switching device, makes it possible, by means of a horizontal connection to the housing, i.e. a connection which is perpendicular to the direction of flow of the arc gases, to simultaneously blow the gases out on the terminal side at some distance from the freely accessible line terminal connections of the terminal chambers.

The invention achieves a high degree of safety against flashover of the arc gases in the vicinity of the terminal chambers of the switch, since a relatively small sealing surface must be sealed, namely only the sealing surface on the terminal side of the blow-out channel to the partition in the vicinity of the passage openings to the quenching chamber of the housing.

To reduce the number of different housing parts required and to create a uniform terminal connection pattern, the terminal cover claimed by the invention can also be used for the terminal side which is on the other side of the quenching chamber.

One feature of the invention resides broadly in an electrical switching device comprising: a housing; switching components being disposed within the housing; the housing comprising: an arc quenching chamber; a terminal chamber; a partition disposed between the arc quenching chamber and the terminal chamber; the partion comprising a passage opening for the discharge of arc gases from the arc quenching chamber; a terminal screw unit disposed in the terminal chamber for the insertion of a terminal connecting device; the terminal screw unit comprising a terminal screw; a terminal cover part for covering the terminal connecting device; the terminal cover part being a separate part from the housing; and the terminal cover part comprising: a through hole for the terminal screw unit; the through hole being disposed coaxial to the terminal screw; a blow-out channel for the flow of arc gases from the quenching chamber; the blow-out channel comprising an outlet opening and an inlet opening; the blow-out channel comprising element for completely encapsulating the blow-out channel with respect to the terminal screw unit and with respect to the terminal chamber; and element for disposing the inlet opening tight up against the partition and for disposing the inlet opening around the passage opening.

BRIEF DESCRIPTION OF THE DRAWINGS

One embodiment of an electric switching device claimed by the invention is explained below, using the example of a power circuit breaker with arc quenching chambers, with reference to the accompanying drawings.

FIG. 1 is a schematic exploded view of a switch with arc quenching chambers;

FIG 6. is a rear view from above, in perspective, of the terminal cover part as shown in FIG. 5;

FIG. 7 is a rear view, in perspective, of the terminal cover part as shown in FIG. 5;

DESCRIPTION OF THE PREFERRED EMBODIMENT

Figure 2:
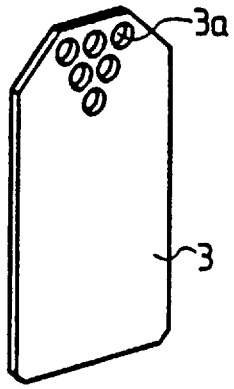
FIG. 2 is a blow-out damper.

FIG. 1 is a schematic illustration of the construction of an electrical switching device, e.g. of a power circuit breaker, which has a housing 10. The housing 10 has a terminal side A with three terminal chambers 13, a switching chamber 14 for the actuation or switching components 6 and for the arc quenching chambers 11 which are adjacent to the terminal chambers 13, as well as a terminal side B which is opposite the terminal side A. Quenching plates 110 are installed in the quenching chambers 11. The quenching chambers 11 are divided from the terminal chambers 13 by the partition 16 of the housing 10. In the terminal chambers 13 there are terminal screw units 2 with terminal screws 2*a*. In the partition 16, in each terminal chamber 13, there is a passage opening 132 for the arc gases which exit in the direction indicated by the arrow G. Behind the partition 16, respective blow-out dampers 3 are located in front of each of the quencher plates 110. The terminal chambers 13 are open on the top and front. On the terminal side A, to cover the terminal chambers 13, a terminal cover part 30 is attached from above, i.e. in the direction indicated by the arrow C, or from the front, i.e. opposite to the direction indicated by the arrow G, on the housing 10—however, when the terminal screw units 2 are already connected to the switching device, the cover part 30 is attached only from above. There is also a housing cover 20 to cover the rest of the housing 10 which is open on the top, whereby in this case additional divisions can also be provided. An additional, generally similar terminal cover part can also be provided for the rear terminal side B.

FIG. 2 shows the realization of a blow-out damper 3 which has damper openings or holes 3*a* for the passage of the arc gases. The location, shape and size of the holes 3*a* can be selected as a function of the individual requirements of the installation.

Figure 3:
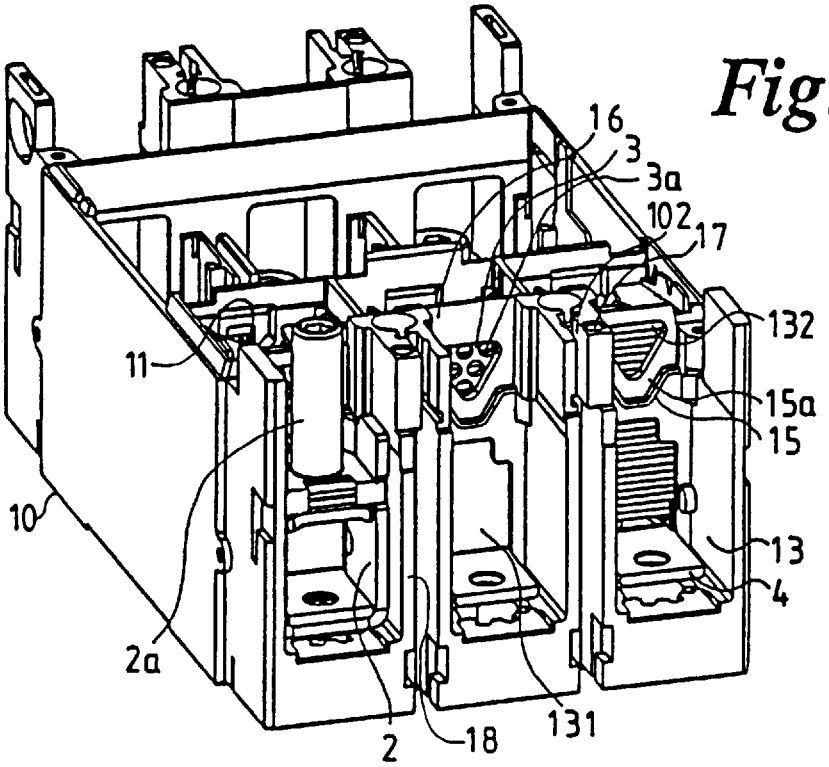
FIG. 3 is a plan view of the terminal side A as shown in FIG. 1 of the housing without the terminal cover part.

FIG. 3 shows in detail the realization of terminal side A of the housing 10 for a power circuit breaker as shown in FIG. 1. The terminal chambers 13 are open on the front and on top. There are three terminal chambers 13, each with a contact rail 4. The terminal chambers 13 are separated from the quenching chambers 11 by the partition 16 which, in the vicinity of each of the contact rails 4 has an opening 131, and on the upper end, the passage opening 132 for the arc gases. The openings 131, 132 are each covered by a blow-out damper 3, whereby in the vicinity of the passage openings 132, the blow-out damper 3 is provided with holes 3*a* for the passage of the arc gases. As the hot arc gases exit, the blow-out damper 3 is pressed firmly against the partition 16, so that no arc gases in the vicinity of the opening 131 can penetrate into the terminal chamber 13. In the vicinity of the partitions 18 which separate the terminal chambers 13, there are holes 17 on the top side for screws to fasten the terminal cover part 30. On the side of the partition 16 facing the terminal chamber 13, below the passage opening 132 and at some distance 15*a* from the passage opening 132, there is a sealing collar 15 which projects toward the terminal chamber 13. This sealing collar 15 forms a contact point for a blow-out channel molded onto the terminal cover part 30, which terminal cover part 30 is described in greater detail below. The terminal chambers 13 are used to hold the terminal screw unit 2 with terminal screws 2*a*, whereby for example box terminals can be used, as shown in the left terminal chamber 13 in FIG. 3.

Figure 4:
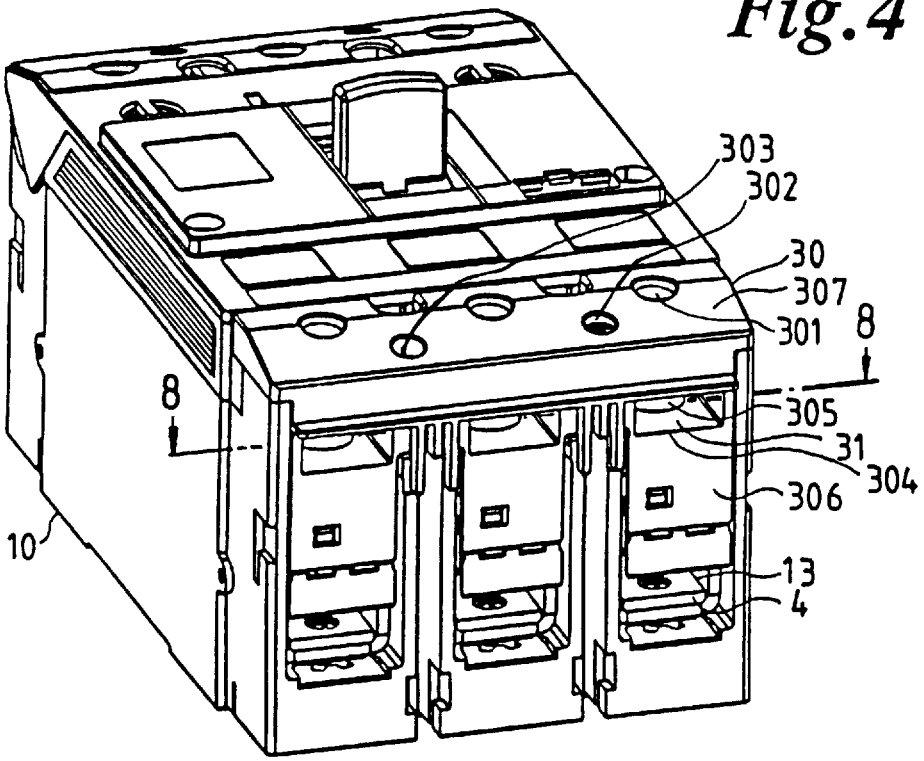
FIG. 4 is a plan view of the terminal side A as shown in FIG. 1 of the housing with the terminal cover part.

The terminal cover part 30 is then pushed onto the housing 10 from above and covers the terminal chambers 13 on the top, and partly on the front, as shown in FIG. 4. The terminal cover part 30 has a roof side 307 which covers the terminal chambers 13 on the upper side of the housing, and cover webs 306 which are bent downward at an angle from it and which cover the terminal chambers 13 on the terminal side A down to the area where the contact rails 4 are connected. The terminal cover part 30 is fastened in the center to the housing 10 by means of the screws which run through the screw holes 302. Molded into each of the screw holes 302, near the terminal side, is an application web 303 which, when the screw is tightened, generates an application force for the terminal cover part 30 against the partition 16 of the housing 10. On the roof side 307 of the terminal cover part 30 there are also additional through holes 301 which are coaxial to the terminal screws 2*a* inserted into the terminal chambers, so that the terminal screws 2*a* can be actuated through these holes. By means of the through holes 301, however, conductors equipped with cable lugs can also be screwed directly to the contact rails 4.

The application web 303 can take the form of a wedge shaped projection molded into the screw holes 302. Upon the tightening down of the terminal cover part 30 onto the housing 10, the wedge shaped application webs 303 can contact a portion of the top of the housing 10. The wedge shaped application webs 303 can then force the terminal cover part 30 towards the partition 16, to insure a tight seal between the blow-out channels 31 and the partition 16.

Figure 5:
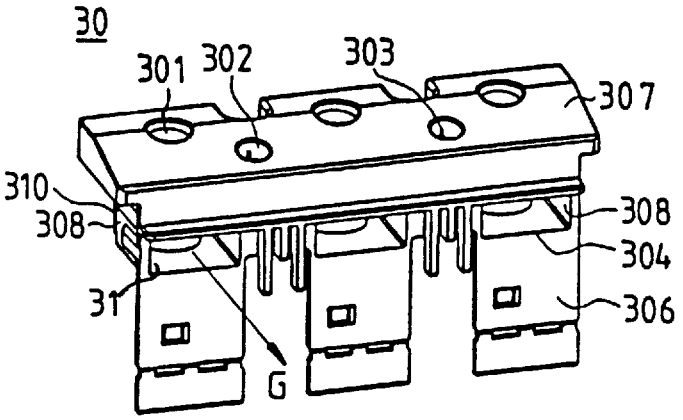
FIG. 5 is a front view, in perspective, of the terminal cover part.

FIGS. 5, 6 and 7 show the terminal cover part 30 from various perspectives. For the closed discharge of the arc gases from the quenching chambers 11 through the passage openings 132 of the partition 16 of the housing 10 and to the outside through the terminal chambers 13, blow-out channels 31 are realized on the terminal cover part 30. These blow-out channels 31 have an enclosure which is closed with respect to the terminal chamber 13 in the form of the channel ducts 308, e.g. with an approximately rectangular cross section which surround the blow-out channel 31. These channel ducts 308 are molded onto the cover webs 306 of the terminal cover part 30 and extend from the terminal side A to the partition 16 over the depth of the terminal chambers 13. The channel ducts 308 have the outlet opening 304 for the blow-out channel on the terminal side A and the inlet opening 310 on the side facing the partition 16 of the housing 10. The inlet opening 310 into the blow-out channel 31 is designed so that it connects appropriately with the passage opening 132 of the partition 16 to the sealing collar 15 (See FIG. 3), i.e. the inlet opening 310 has a corresponding downward overhang 313 with a sealing surface 312. The terminal cover part 30 can then be placed with the inlet opening 310 of the channel ducts 308 so that the sealing surface 312 fits with the sealing collar 15, and the sealing surface 312 can be pressed against the partition 16 when the terminal cover part 30 is screwed onto the housing 10. In this manner, a tight connection of the blow-out channels 31 on the housing 10 is achieved in the vicinity of the passage openings 132 to the quenching chambers 11, and thus a high degree of security against the flashover of the arc into the terminal chambers 13. The arc gases are blown out, i.e. they are transported from the quenching chamber 11 via the sealed connection point between the partition 16 and the blow-out channels 31 to their outlet side on the terminal side A. The channel ducts 308 which form the blow-out channels 31 are penetrated at a right angle by a tubular location dome 305. The location dome 305 has a through hole 309 which, when the terminal cover part 30 is installed on the housing 10, runs coaxial to the terminal screw 2*a*. The hole 309 also runs coaxial to the through hole 301 on the roof side 307 of the terminal cover part 30, so that the terminal screw 2*a* can be inserted through the hole 309 and can be actuated through the through hole 301 and the hole 309. The location dome 305 can project by means of a part 305*a* on the underside of the channel ducts 308. The location dome 305 divides the flow cross section of the blow-out channel 31 into two subchannels 31*a*, 31*b*, and simultaneously reduces the flow cross section by its own cross section. The location dome 305 protects the terminal screw unit 2 and the terminal chambers 13 from the penetration of arc gases from the blow-out channel 31. In this manner, it is possible to realize a switch which is protected against arcing, in particular a terminal side A which is protected against arcing.

Figure 8:
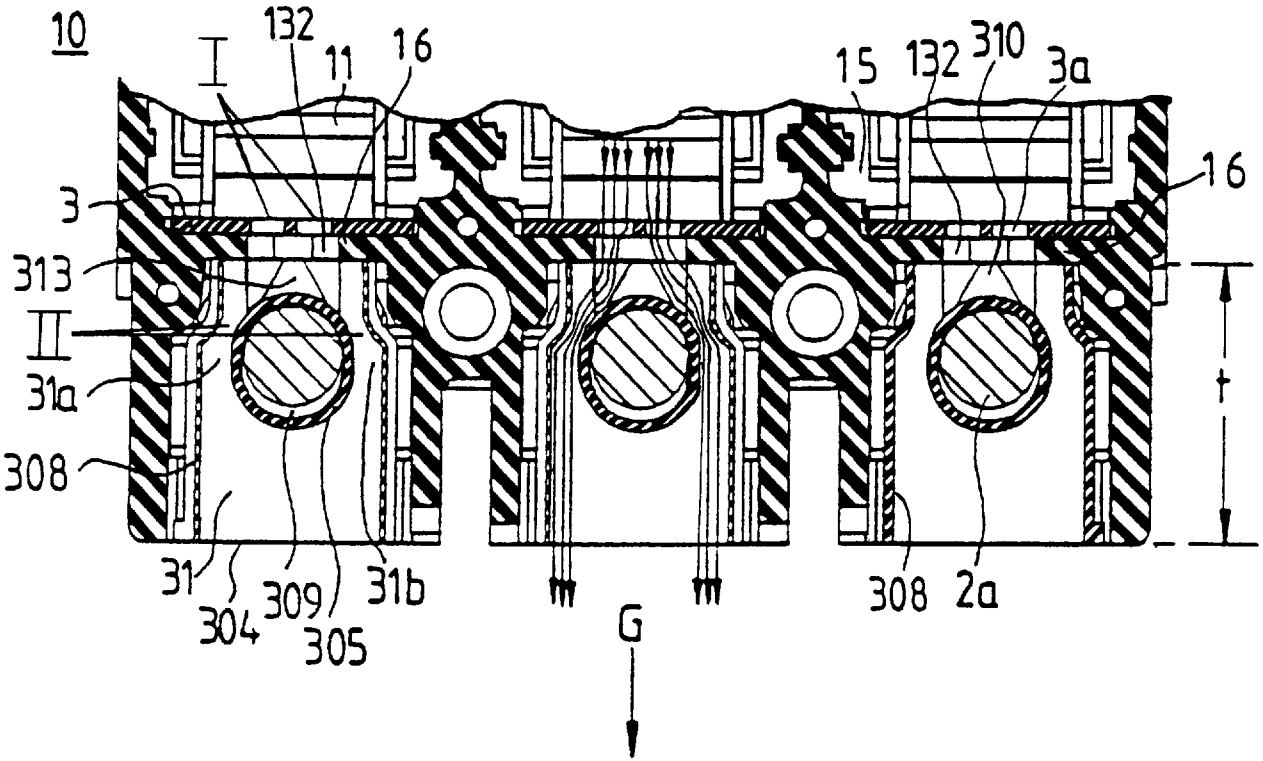
FIG. 8 is a sectional view along line 8—8 in FIG. 4.

To make possible the rapid deionization and discharge of the arc gases, the flow path of the arc gases out of the quenching chamber 11 to the outside is direct, i.e. the flow path is in a flow plane G, and it can also be realized with narrower portions I, II alternating with expanded portions which ensure a good mixing of the arc gases with fresh air, as shown in FIG. 8. The arc gases thereby pass through the holes 3*a* of the blow-out damper 3 which form the first narrow point I, and the passage opening 132 of the partition 16 of the housing 10 into the inlet opening 310 of the blow-out channel 31, which inlet opening 310 is enlarged by the overhang 313. The cross section of the blow-out channel 31 is then reduced by the location dome 305 which runs through the blow-out channel 31 at a right angle, and is divided into the subchannels 31*a,* 31*b.* These two subchannels 31*a,* 31*b* form the second narrower point II for the gases produced by the arc. After that, the arc gases flow in the direction G out of the outlet opening 304. The entire flow path of the arc gases from the quenching chamber 11 to the outlet opening 304 is closed and sealed with respect to the terminal chambers 13. An optimal mixture and cooling of the arc gases is achieved as the arc gases pass through the first narrow point I, the expanded portion of the blow-out channel at the connection point and then via the second narrow point II in the blow-out channel 31, which is followed by an expanded portion downstream, to the final blow-out from the terminal cover part 30.

In this embodiment of the terminal cover part 30 with molded blow-out channels 31, the line connections remain freely accessible from the front (See FIG. 4) and the lines can be inserted and connected without interference, when the terminal cover 30 is removed as shown in FIG. 3. As a result of the relatively small sealing surface 312 in the vicinity of the inlet opening 310 of the blow-out channel 31 which is molded on the terminal cover part 30, and the partition 16 of the housing, a high degree of safety against flashover is achieved. A high make-break capacity can be achieved in a small component, and relatively large terminal screw units 2 can be used. The simple construction means that manufacturing costs are also low. In the illustrated example, the passage opening 132 is approximately triangular, but it can also have a different shape. When the triangular shape is used, the sealing collar 15 can be provided in the lower part with an overhang or a collar, as appropriate, to achieve a good fit and seal with the blow-out channel 31 to be connected to it.

A labyrinth seal can also be provided on the bottom in the vicinity of the sealing collar 15, e.g. by means of an additional groove above the passage opening 132, by realizing a groove 311 in the vicinity of the contact surface of the blow-out channel 31 (See FIG. 6).

That is, a labyrinth seal at the contact surface between the sealing collar 15 and the sealing surface 312 creates an even tighter seal between the flow path of the arc gases and the terminal chambers 13. The groove 311 is shown in FIGS. 6 and 7 at the upper portion of the sealing surface 312, however the groove could completely encircle the sealing surface 312. The groove 311 is positioned on the sealing surface 312 to fit about the projecting sealing collar 15. Alternatively, the groove could be located around the passage opening 132, and the sealing surface 312 could have a projecting collar to fit into the groove.

Figure 9:
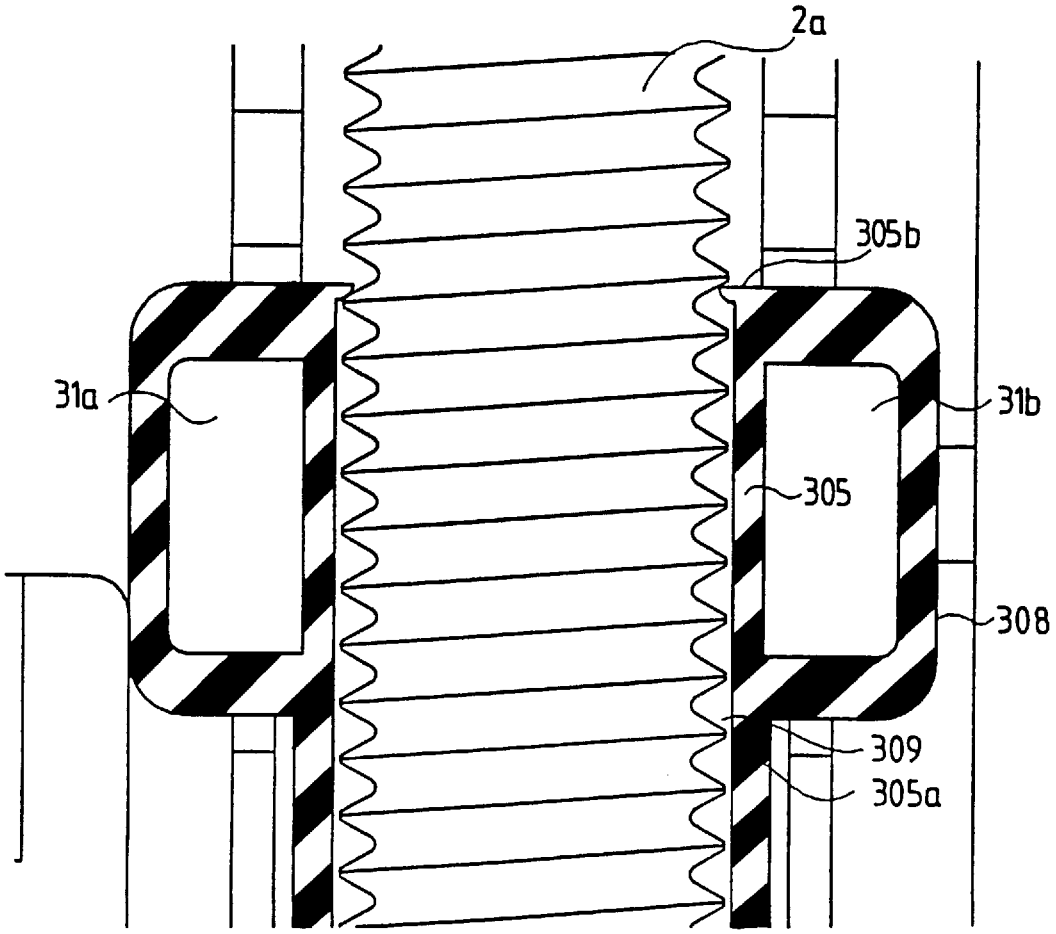
FIG. 9 is a sectional view along line 9—9 of the detail in FIG. 7, on a larger scale.

To prevent the terminal screw unit 2 with the terminal screw 2*a* from falling out of the terminal cover part 30 when the terminal cover part 30 is removed, the invention teaches that a retaining capability is provided for the terminal screw 2*a,* as shown in FIG. 9. The location dome 305 is provided with lateral retaining projections 305*b* in the vicinity of its through hole 309, preferably in the upper part. The terminal screw 2*a* is then held by the engagement of its thread on the projection 305*b.* FIG. 9 clearly shows the subchannels 31*a,* 31*b* for the arc gases, which have a closed cross section, i.e. the subchannels 31*a,* 31*b* are encapsulated with respect to the terminal chamber 13.

The configuration of the terminal cover part 30 claimed by the invention, with blow-out channels 31 which are encapsulated with respect to the terminal chambers 13, including an encapsulated retaining system for the terminal screw units 2, makes possible an easy pre-assembly and assembly of the switch, as well as the disassembly of the switch for the replacement of individual components. The transport of the arc gases in the blow-out channels 31 makes possible a controlled discharge of the arc gases without any contact with the line connections. The invention also makes possible the configuration of terminal chambers 13 (See FIG. 3), which are no longer divided into different levels by partitions, since the blow-out channels 31 are molded on the terminal cover part 30—and not on the housing 10. In this manner, the assembly and disassembly of the connections can be made an easy and user-friendly process.

To prevent the terminal cover 30 from falling out of the housing 10 when the fastening screws are not yet in place in the screw holes 302 and the holes 17, and when the terminal screw units 2 are not yet installed, there are two insertion slots 102 formed in the housing 10 on the terminal side A and two more, if necessary, on the terminal side B, in the partitions 18 between the terminal chambers 13 (See FIG. 3), into which the snap webs 315 (See FIGS. 6 and 7) which are molded onto the terminal cover part 30 are inserted.

One feature of the invention resides broadly in the electrical switching device with a housing 10 containing the actuation components of the switching device, including arc quenching chambers 11, with a terminal side A separated from the quenching chambers 11 by a partition 16 of the housing 10, which terminal side A has open terminal chambers 13 for the insertion of terminal screw units 2 with a terminal screw 2*a* and with an opposite terminal side B, and with a terminal cover part 30 for the terminal screw units 2 on the quenching-chamber-side terminal side A with a through hole 301 for the screw connection oriented coaxial to each terminal screw 2*a,* whereby corresponding to each terminal chamber 13, there are both passage openings 132 to the quenching chambers 11 in the partition 16 and outlet openings 304 in the terminal cover part 30 on the terminal side A for the discharge of arc gases from the quenching chambers 11, characterized by the fact that the terminal cover part 30 is realized with blow-out channels 31 which are completely encapsulated with respect to the terminal screw units 2 and with respect to the terminal chambers 13, which blow-out channels 31 have an inlet opening 310 and an outlet opening 304 for the flow of the arc gases, and when the terminal cover part 30, is installed on the housing 10, the terminal cover part 30 is in contact in the vicinity of the inlet openings 310 of the blow-out channels 31 tight up against the partition 16 which is adjacent to the passage openings 132.

Another feature of the invention resides broadly in the switching device characterized by the fact that the blow-out channels 31 are realized on the terminal cover part 30 in the form of molded channel ducts 308, and are each completely penetrated by a location dome 305 which is perpendicular to the flow direction G of the arc gases and coaxial to the terminal screw 2*a* inserted perpendicularly into the respective terminal chamber 13, which location dome 305 has a through hole 309 for the terminal screw 2*a* and divides the blow-out channel 31 over portions of its length into two subchannels 31*a,* 31*b* which have a total flow cross section which is less than the flow cross section of the other segments of the blow-out channel 31.

Yet another feature of the invention resides broadly in the switching device characterized by the fact that the channel ducts 308 each have a length which equals the depth t of the terminal chambers 13.

Still another feature of the invention resides broadly in the switching device characterized by the fact that the terminal cover part 30 has an angular shape with a roof side 307 which covers the terminal chambers 13 on the upper side of the housing, and cover webs 306 attached at an angle which cover webs 306 partly cover the open front sides of the terminal chambers 13 of the housing 10, whereby the channel ducts 308 of the blow-out channels 31 are molded onto the cover webs 306.

A further feature of the invention resides broadly in the switching device characterized by the fact that at the connection points of the blow-out channels 31 to the passage openings 132 on the partition 16, below the passage openings 132, a sealing collar 15 is molded, which sealing collar 15 projects into the terminal chamber 13, whereby the inlet opening 310 of the blow-out channels 31 on the terminal cover part 30 has a corresponding downward-pointing overhang, and the inlet opening 310 can be placed on the sealing collar.

Another feature of the invention resides broadly in the switching device characterized by the fact that at the connection point of the blow-out channels 31 to the passage openings 132 of the partition 16, a labyrinth seal is formed at the contact surfaces, at least in partial areas, by means of grooves 311 on the channel ducts 308 and/or on a sealing collar 15 which sealing collar 15 projects from the partition 16.

Yet another feature of the invention resides broadly in the switching device characterized by the fact that the flow path G of the arc gases in the vicinity of the passage openings 132, at the outlet from the quenching chambers 11 is realized by means of a blow-out damper 3 which is provided with outlet openings 3*a* and partly covers the passage openings 132, with a first narrow portion followed by an expanded portion of the flow path at the inlet into the blow-out channel 31, followed by a second narrow portion at the point where the flow path flows around the location dome 305 which penetrates the blow-out channel 31 and reduces its flow cross section.

Still another feature of the invention resides broadly in the switching device characterized by the fact that the terminal cover part 30 which can be fastened to the housing 10 by means of screws can be pressed against the partition 16 of the housing 10 as a result of the realization of an application web 303 in the screw holes 302 of the terminal cover part 30 with the ends of the channel ducts 308 which comprise the inlet openings 310 of the blow-out channels 31.

A further feature of the invention resides broadly in the switching device characterized by the fact that the location dome 305 has a projection 305*b* which projects into the through hole 309 to hold the terminal screw 2*a* by engagement with its thread when the terminal cover part 30 is inserted into the housing 10.

Another feature of the invention resides broadly in the switching device characterized by the fact that the outlet openings 304 of the blow-out channels 31 are located on the open front terminal side A of the terminal chambers 13 of the housing 10.

Examples of electrical switching devices which could possibly be used with the present invention can be found in the following U.S. Pat. Nos.: 5,186,316; 5,187,336; 5,196,657; 5,220,726; 5,213,204; 5,256,841; 5,262,602; 5,285,030; 5,286,920; 5,293,018; 5,294,758; and 5,296,663.

Examples of electrical terminal connectors which could possibly be used with the present invention can be found in the following U.S. Pat. Nos.: 4,895,529; 4,902,243; 4,908,942; 4,921,456; 4,932,906; 4,943,248; 4,946,405; 4,948,380; 4,952,171; 4,957,452; 4,969,845; 4,995,838; 5,035,648; and 5,076,795.

Examples of application webs which could possibly be used with the present invention can possibly be found in the following U.S. Pat. Nos.: 5,224,865; 4,890,818; 4,904,109; 5,067,908; and 5,145,381.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein. The corresponding foreign and international patent publication applications, namely, Federal Republic of Germany Patent application No. G 94 06 404.0, filed on Apr. 20, 1994, having publication No. G 94 06 404, and International application No. PCT/DE95/00520, filed on Apr. 15, 1995, having publication No. WO 95/29497 which published on Nov. 2, 1995, having inventors Christoph Bausch, Franz Böder, and Bernd Howald, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. An electrical switching device comprising:

a housing;

electrical switching components being disposed within said housing;

said housing comprising:

an arc quenching chamber to quench electrical arcs from said electrical switching components;

a terminal chamber to house electrical conductor connections;

a partition disposed between said arc quenching chamber and said terminal chamber;

said partition comprising a partition passage opening to discharge arc gases from said arc quenching chamber;

a terminal connecting unit to connect an electrical conductor to said electrical switching device;

said terminal connecting unit being disposed in said terminal chamber;

a terminal cover part to cover said terminal connecting unit;

said terminal cover part being a separate part from said housing; and said terminal cover part comprising:

a through-hole to permit access to said terminal connecting unit to permit connection of an electrical conductor to said electrical switching device;

a blow-out channel to direct the flow of arc gases through said terminal chamber;

said blow-out channel comprising an outlet opening, an inlet opening, and a channel passage disposed between said inlet opening and said outlet opening;

said channel passage comprising an arrangement for completely encapsulating said channel passage with respect to said terminal connecting unit and with respect to said terminal chamber;

an arrangement for disposing said inlet opening tightly up against said partition; and an arrangement for disposing said inlet opening around said partition passage opening.

2. The electrical switching device of claim 1, wherein:

said terminal connecting unit has a longitudinal axis;

said blow-out channel comprises a molded channel duct to direct the flow of arc gases through said terminal chamber;

said encapsulating arrangement comprises a location dome molded into said molded channel duct to form a hole penetrating said molded channel duct;

said hole penetrating said molded channel duct is said through-hole;

said location dome has a longitudinal axis substantially coaxial to the longitudinal axis of said terminal connecting unit;

said molded channel duct has an axis defined along the flow direction of arc gases; and said location dome is disposed so that the longitudinal axis of said location dome is oriented substantially perpendicular to the axis along the flow path.

3. The electrical switching device of claim 2, wherein:

said location dome is disposed to divide said blow-out channel over a portion of said blow-out channel into two subchannels;

said blow-out channel has a first cross sectional area for the flow of arc gases;

said two subchannels have a combined cross sectional area for the flow of arc gases;

said combined cross sectional area of said two subchannels is a second cross sectional area; and said first cross sectional area is greater than said second cross sectional area.

4. The electrical switching device of claim 3, wherein:

said terminal chamber has a depth;

said channel duct has a length; and the length of said channel duct is substantially equal to the depth of said terminal chamber.

5. The electrical switching device of claim 4, wherein:

said terminal chamber has a top side disposed adjacent to said through-hole;

said terminal chamber has a front side disposed adjacent said outlet opening;

said terminal cover part comprises a roof side for covering said top side of said terminal chamber;

said roof side is disposed at a non-zero angle with respect to said top side of said terminal chamber;

said terminal cover part comprises a cover web attached to said roof side at a non-zero angle with respect to said roof side;

said cover web is disposed to at least partially cover said front side of said terminal chamber; and said molded channel duct is molded onto said cover web.

6. The electrical switching device of claim 4 wherein:

said partition passage opening comprises a portion adjacent to said terminal connecting unit;

said partition comprises a sealing collar molded into said partition to seal against said inlet opening;

said sealing collar is disposed adjacent to said portion of said partition passage opening;

said sealing collar is dimensioned to extend into said terminal chamber;

said arrangement for disposing said inlet opening around said partition passage comprises a downward-pointing overhang disposed on said inlet opening; and said downward-pointing overhang is dimensioned to fit on said sealing collar.

7. The electrical switching device of claim 4, wherein:

said electrical switching device comprises an arrangement for forming a labyrinth seal between said inlet opening and said partition; and said labyrinth seal arrangement comprises at least one of:

grooves disposed at least in sections about said inlet opening; and a sealing collar dimensioned to extend into said terminal chamber, said sealing collar being disposed at least in sections around said partition passage opening.

8. The electrical switching device of claim 3, wherein:

said electrical switching device comprises a blow-out damper to dampen flow of arc gas through said partition passage opening;

said blow-out damper is disposed adjacent to said partition passage opening to at least partially cover said partition passage opening;

said blow-out damper comprises at least one damper opening;

said partition passage opening has a cross-sectional area;

said at least one damper opening has a cross-sectional area;

the cross-sectional area of said damper opening is less than the cross-sectional area of said partition passage opening;

said blow-out channel has a cross-sectional area adjacent to said inlet opening;

the cross-sectional area adjacent said inlet opening is the first cross-sectional area of said blow-out channel; and the first cross-sectional area is greater than the cross-sectional area of said damper opening.

9. The electrical switching device of claim 4, wherein:

said terminal cover part comprises an arrangement for being fastened to said housing by screws;

said fastening arrangement comprises a screw hole;

said screw hole comprises said arrangement for disposing said inlet opening tightly up against said partition upon the fastening of said terminal cover part to said housing; and said arrangement for disposing said inlet opening tightly up against said partition comprises an application web disposed in said screw hole.

10. The electrical switching device of claim 1, wherein:

said terminal chamber has a top side disposed adjacent to said through-hole;

said terminal chamber has a front side disposed substantially perpendicular to said top side; and said outlet opening is disposed at said front side.

11. The electrical switching device of claim 3, wherein:

said terminal chamber has a top side disposed adjacent to said through-hole;

said terminal chamber has a front side disposed substantially perpendicular to said top side; and said outlet opening is disposed at said front side.

12. The electrical switching device of claim 1, wherein:

said terminal connecting unit comprises a terminal screw to connect an electrical conductor to said electrical switching device;

said through-hole is disposed coaxial to said terminal screw;

said blow-out channel comprises a molded channel duct to direct the flow of arc gases through said terminal chamber;

said encapsulating arrangement comprises a location dome molded into said molded channel duct to form a hole penetrating said molded channel duct;

said hole penetrating said molded channel duct is said through-hole;

said location dome has a longitudinal axis coaxial to said terminal screw;

said molded channel duct has an axis defined along the flow direction of arc gases;

said location dome is disposed so that the longitudinal axis of said location dome is oriented substantially perpendicular to the axis along the flow path;

said location dome is disposed to divide said blow-out channel over a portion of said blow-out channel into two subchannels;

said blow-out channel has a first cross sectional area for the flow of arc gases;

said two subchannels have a combined cross sectional area for the flow of arc gases;

said combined cross sectional area of said two subchannels is a second cross sectional area;

said first cross sectional area is greater than said second cross sectional area;

said terminal chamber has a depth;

said channel duct has a length;

the length of said channel duct is substantially equal to the depth of said terminal chamber;

said terminal chamber has a top side disposed adjacent to said through-hole;

said terminal chamber has a front side disposed adjacent said outlet opening;

said terminal cover part comprises a roof side for covering said top side of said terminal chamber;

said roof side is disposed at a non-zero angle with respect to said top side of said terminal chamber;

said terminal cover part comprises a cover web attached to said roof side at a non-zero angle with respect to said roof side;

said cover web is disposed to at least partially cover the front side of said terminal chamber;

said molded channel duct is molded onto said cover web;

said partition passage opening comprises a portion adjacent to said terminal connecting unit;

said partition comprises a sealing collar molded into said partition to seal against said inlet opening;

said sealing collar is disposed adjacent to said portion of said partition passage opening;

said sealing collar is dimensioned to extend into said terminal chamber;

said arrangement for disposing said inlet opening around said partition passage comprises a downward-pointing overhang disposed on said inlet opening;

said downward-pointing overhang is dimensioned to fit on said sealing collar;

said electrical switching device comprises an arrangement for forming a labyrinth seal between said inlet opening and said partition;

said labyrinth seal arrangement comprises at least one of:

grooves disposed at least in sections about said inlet opening; and said sealing collar being disposed at least in sections around said partition passage opening;

said electrical switching device comprises a blow-out damper to dampen flow of arc gas through said partition passage opening;

said blow-out damper is disposed adjacent to said partition passage opening to at least partially cover said partition passage opening;

said blow-out damper comprises at least one damper opening;

said partition passage opening has a cross-sectional area;

said at least one damper opening has a cross-sectional area;

the cross-sectional area of said damper opening is less than the cross-sectional area of said partition passage opening;

said blow-out channel has a cross-sectional area adjacent to said inlet opening;

the cross-sectional area adjacent said inlet opening is the first cross-sectional area of said blow-out channel;

the first cross-sectional area is greater than the cross-sectional area of said damper opening;

said terminal cover part comprises an arrangement for being fastened to said housing by screws;

said fastening arrangement comprises a screw hole;

said screw hole comprises said arrangement for disposing said inlet opening tightly up against said partition upon the fastening of said terminal cover part to said housing;

said arrangement for disposing said inlet opening tightly up against said partition comprises an application web disposed in said screw hole;

said terminal chamber has a top side disposed adjacent to said through-hole;

said terminal chamber has a front side disposed substantially perpendicular to said top side;

said outlet opening is disposed at said front side;

said location dome comprises an arrangement for engaging a thread of said terminal screw to hold said terminal screw in said through-hole; and said engaging arrangement comprises a projection projecting into said through-hole.

13. The electrical switching device of claim 1, wherein:

said terminal connecting unit comprises a terminal screw to connect an electrical conductor to said electrical switching device; and said through-hole is disposed coaxial to said terminal screw.

14. The electrical switching device of claim 13 wherein:

said blow-out channel comprises a molded channel duct to direct the flow of arc gases through said terminal chamber;

said encapsulating arrangement comprises a location dome molded into said molded channel duct to form a hole penetrating said molded channel duct;

said hole penetrating said molded channel duct is said through-hole;

said location dome has a longitudinal axis coaxial to said terminal screw;

said molded channel duct has an axis defined along the flow direction of arc gases; and said location dome is disposed so that the longitudinal axis of said location dome is oriented substantially perpendicular to the axis along the flow path.

15. The electrical switching device of claim 14, wherein:

said location dome is disposed to divide said blow-out channel over a portion of said blow-out channel into two subchannels;

said blow-out channel has a first cross sectional area for the flow of arc gases;

said two subchannels have a combined cross sectional area for the flow of arc gases;

said combined cross sectional area of said two subchannels is a second cross sectional area; and said first cross sectional area is greater than said second cross sectional area.

16. The electrical switching device of claim 15, wherein:

said terminal chamber has a depth;

said channel duct has a length; and the length of said channel duct is substantially equal to the depth of said terminal chamber.

17. The electrical switching device of claim 15, wherein:

said electrical switching device comprises a blow-out damper to dampen flow of arc gas through said partition passage opening;

said blow-out damper is disposed adjacent to said partition passage opening to at least partially cover said partition passage opening;

said blow-out damper comprises at least one damper opening;

said partition passage opening has a cross-sectional area;

said at least one damper opening has a cross-sectional area;

the cross-sectional area of said damper opening is less than the cross-sectional area of said partition passage opening;

said blow-out channel has a cross-sectional area adjacent to said inlet opening;

the cross-sectional area adjacent said inlet opening is the first cross-sectional area of said blow-out channel; and the first cross-sectional area is greater than the cross-sectional area of said damper opening.

18. The electrical switching device of claim 15, wherein:

said location dome comprises an arrangement for engaging a thread of said terminal screw to hold said terminal screw in said through-hole; and said engaging arrangement comprises a projection projecting into said through-hole.

19. The electrical switching device of claim 16, wherein:

said location dome comprises an arrangement for engaging a thread of said terminal screw to hold said terminal screw in said through-hole; and said engaging arrangement comprises a projection projecting into said through-hole.

20. The electrical switching device of claim 17, wherein:

said location dome comprises an arrangement for engaging a thread of said terminal screw to hold said terminal screw in said through-hole; and said engaging arrangement comprises a projection projecting into said through-hole.

* * * * *

UNITED STATES PATENT AND TRADEMARK OFFICE

CERTIFICATE OF CORRECTION

PATENT NO. : 5,811,749

DATED : September 22, 1998

INVENTOR(S) : Christoph BAUSCH, Franz BÖDER, and Bernd HOWALD

It is certified that error appears in the above-identified patent and that said Letters Patent is hereby corrected as shown below:

On the title page, item [63], after 'PCT/DE95/00520', delete "Apr. 20, 1994" and insert --Apr. 15, 1995--.

In column 1, line 5, after '00520', delete "Apr. 20, 1994" and insert --Apr. 15, 1995--.

Signed and Sealed this

Eighth Day of June, 1999

*Attest:*

Q. TODD DICKINSON

*Attesting Officer*

*Acting Commissioner of Patents and Trademarks*